US011515649B2

(12) United States Patent
Wu et al.

(10) Patent No.: US 11,515,649 B2
(45) Date of Patent: Nov. 29, 2022

(54) ANTENNA AND MOBILE TERMINAL

(71) Applicant: Huawei Technologies Co., Ltd., Shenzhen (CN)

(72) Inventors: Pengfei Wu, Shanghai (CN); Hanyang Wang, Reading (GB); Chien-Ming Lee, Shenzhen (CN); Dong Yu, Shanghai (CN); Jiaqing You, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 78 days.

(21) Appl. No.: 17/044,174

(22) PCT Filed: Apr. 25, 2018

(86) PCT No.: PCT/CN2018/084490
§ 371 (c)(1),
(2) Date: Sep. 30, 2020

(87) PCT Pub. No.: WO2019/205029
PCT Pub. Date: Oct. 31, 2019

(65) Prior Publication Data

US 2021/0036431 A1 Feb. 4, 2021

(51) Int. Cl.
*H01Q 21/06* (2006.01)
*H01Q 1/52* (2006.01)
(Continued)

(52) U.S. Cl.
CPC ..... *H01Q 21/064* (2013.01); *H01Q 1/24* (2013.01); *H01Q 1/52* (2013.01); *H01Q 1/523* (2013.01);
(Continued)

(58) Field of Classification Search
CPC ..... H01Q 21/064; H01Q 1/24; H01Q 13/16; H01Q 21/06; H01Q 1/52; H01Q 5/40; H01Q 1/523; H01Q 5/392
(Continued)

(56) References Cited

U.S. PATENT DOCUMENTS 6,608,594 B1 * 8/2003 Kane ..... H01Q 19/005 343/834
2005/0264455 A1 12/2005 Talvitie et al.
(Continued)

FOREIGN PATENT DOCUMENTS

CN 103811869 A 5/2014
CN 204375951 U 6/2015
(Continued)

*Primary Examiner* — Hai V Tran
(74) *Attorney, Agent, or Firm* — Conley Rose, P.C.

(57) ABSTRACT

An antenna and a mobile terminal are provided. The antenna includes a plurality of antenna units arranged in an array, and each antenna unit includes a first radiating element and a second radiating element, where the first radiating element includes a first slot disposed on a metal layer, the second radiating element includes at least one radiating stub, and the first radiating element is coupled to the at least one radiating stub. In any two adjacent antenna units, a feeder of one antenna unit is connected to a first radiating element of the antenna unit, and a feeder of the other antenna unit is connected to a second radiating element of the antenna unit. In the technical solution, feeders of adjacent antenna units are directly connected to different first radiating elements and second radiating elements.

20 Claims, 15 Drawing Sheets

(51) Int. Cl.
*H01Q 1/24* (2006.01)
*H01Q 13/16* (2006.01)
*H01Q 5/40* (2015.01)

(52) U.S. Cl.
CPC ..... *H01Q 5/40* (2015.01); *H01Q 13/16* (2013.01); *H01Q 21/06* (2013.01)

(58) Field of Classification Search
USPC ..... 343/770
See application file for complete search history.

(56) References Cited

U.S. PATENT DOCUMENTS

| | | | | |
|---|---|---|---|---|
| 2007/0001911 | A1* | 1/2007 | Fujio | H01Q 9/42 343/700 MS |
| 2009/0147434 | A1 | 6/2009 | Gabara | |
| 2009/0153407 | A1 | 6/2009 | Zhang et al. | |
| 2016/0294048 | A1* | 10/2016 | Xu | H01Q 1/2291 |
| 2016/0336643 | A1 | 11/2016 | Pascolini et al. | |

FOREIGN PATENT DOCUMENTS

| | | | |
|---|---|---|---|
| CN | 107732433 | A | 2/2018 |
| EP | 2648277 | A1 | 10/2013 |
| EP | 3113285 | A1 | 1/2017 |

* cited by examiner

ANTENNA AND MOBILE TERMINAL

CROSS-REFERENCE TO RELATED APPLICATIONS

This application is a U.S. National Stage of International Patent Application No. PCT/CN2018/084490 filed on Apr. 25, 2018, which is hereby incorporated by reference in its entirety.

TECHNICAL FIELD

This application relates to the field of communications technologies, and in particular, to an antenna and a mobile terminal.

BACKGROUND

Rapid development of a fourth generation mobile communication technology allows wider and deeper application of a MIMO antenna technology to a terminal. Specifically, a quantity of antennas is exponentially increasing and a frequency band range is wider. This brings a great challenge to an antenna design of a terminal product, especially a terminal of a metallic ID. Currently, mobile phones of a metallic ID in the market require a high compact structure. A recent trend is a high screen-to-body ratio after using a full-display technique, to further reduce space of a communications antenna.

Currently, a known solution is feeding a second radiating element and adding a coupling stub as a MIMO antenna unit. As shown in FIG. 1, a sign 1 indicates a feeding antenna, and a sign 2 indicates a coupling antenna. The coupling antenna and the feeding antenna may be designed to be electric field coupling or magnetic field coupling (only an electric coupling manner is illustrated in FIG. 1), to increase an antenna bandwidth. In addition, when a MIMO system is formed (as shown in FIG. 2), a plurality of MIMO antenna units are disposed in parallel, and the coupling antenna can improve isolation between MIMO units. However, a disadvantage of this solution is that an antenna has comparatively high space requirements and a comparatively large spacing is required between the MIMO antenna units. As shown in FIG. 2, a spacing between a MIMO 1 and a MIMO 2 is d 1, and a spacing between the MIMO 2 and an MIMO 3 is d 2. Consequently, the entire MIMO system occupies comparatively large space in a mobile terminal.

SUMMARY

This application provides an antenna and a mobile terminal, to help reduce space occupied by the antenna and facilitate antenna disposition.

According to a first aspect, an antenna is provided. The antenna includes a plurality of antenna units arranged in an array, and each antenna includes a feeder, a first radiating element, and a second radiating element. When the feeder is connected to the two radiating elements, different connection manners may be selected. The feeder may be connected to the first radiating element, or the feeder may be connected to the second radiating element. When the antenna units are arranged in the arrays, in any two adjacent antenna units, a feeder of one antenna unit is connected to a first radiating element of the antenna unit, and a feeder of the other antenna unit is connected to a second radiating element of the antenna unit. When the feeder is connected to the first radiating element, the second radiating element is coupled to the first radiating element and serves as a coupling antenna. When the feeder is connected to the second radiating element, the first radiating element is coupled to the second radiating element and serves as a coupling antenna. When the first radiating element and the second radiating element are specifically disposed, the first radiating element includes a first slot disposed on a metal layer, the second radiating element is a metal sheet-like radiating element, and the second radiating element includes at least one radiating stub. Regardless of whether the feeder is connected to either the first radiating element or the second radiating element, that the first slot is coupled to the at least one radiating stub is specifically: When the second radiating element includes one radiating stub, the first radiating element is coupled to the one radiating stub; and when the second radiating element includes two or more radiating stubs, the first radiating element is coupled to at least one of the two or more radiating stubs.

In the technical solution, feeders of adjacent antenna units are directly connected to different first radiating elements and second radiating elements. Therefore, isolation between the two adjacent antenna units is increased, and space occupied by the antenna is reduced.

To further improve the isolation between the adjacent antennas, in any two adjacent antenna units, operating frequencies corresponding to two adjacent first slots are different, and in any two adjacent antenna units, operating frequencies of two radiating stubs with a minimum spacing in adjacent second radiating elements are different. Therefore, the isolation between the two adjacent antenna units is increased.

To further improve the isolation between the adjacent antennas, in any two adjacent antenna units, a spacing between radiating stubs operating at a same frequency is greater than a specified value. Therefore, the isolation between the two adjacent antenna units is increased.

In a specific implementation solution, a quantity of the antenna units is an even number, and the even number of the antenna units are arranged side by side in two rows.

When the second radiating element is specifically disposed, the second radiating element may be a radiating element of a single radiating stub, or may be a radiating element including two or more radiating elements. However, regardless of which of the foregoing structures is used, in a specific implementation solution, the radiating stubs of the second radiating element include at least one bent radiating stub. Specifically, when the second radiating element is the single radiating stub, the radiating stub is a bent radiating stub, and when the second radiating element includes the two or more radiating stubs, at least one of the two or more radiating stubs may be a bent radiating stub.

When the second radiating element is specifically disposed, the second radiating element includes the two or more radiating stubs, and operating frequencies of the two or more radiating stubs are different. Therefore, different radiating stubs correspond to different operating frequencies, to increase a bandwidth of the antenna and improve performance.

When the first radiating element is specifically disposed, the first slot of the first radiating element is a bent slot. Therefore, space can be appropriately used by disposing the bent slot, to facilitate disposing of the entire antenna unit.

When the first radiating element is specifically disposed, two ends of the first slot of the first radiating element are closed.

When the first radiating element is specifically disposed, an insulation layer is disposed in the first slot of the first radiating element. A dielectric constant of the first slot can be improved by using the insulation layer, and a length of the first slot can be reduced at a same operating frequency.

When the first radiating element is specifically disposed and when the second radiating element is connected to the feeder, a side wall of the first slot is grounded by using a capacitor.

When the first radiating element is connected to the feeder, the metal layer is a ground plane, and the second radiating element is connected to the metal layer. At a same operating frequency, the length of the first slot may be reduced.

To improve the bandwidth of the antenna, the first radiating element further includes a second slot that is disposed at the metal layer and that is connected to the first slot, and the second slot is coupled to at least one radiating stub of the second radiating element. The second slot is disposed to be coupled to one radiating stub of the second radiating element, to increase the bandwidth and improve the performance.

According to a second aspect, a terminal is provided. The mobile terminal includes the antenna unit according to any one of the foregoing or the antenna array according to any one of the foregoing.

In the technical solution, feeders of the adjacent antenna units are directly connected to different first radiating elements and second radiating elements. Therefore, isolation between the two adjacent antenna units is increased, and space occupied by the antenna is reduced.

In a specific implementation solution, a housing, a middle frame disposed in the housing, and an antenna support disposed in a stacked manner with the middle frame are included. The first radiating element is disposed on the middle frame, and the second radiating element is disposed on the antenna support. The antenna unit is supported by using the middle frame and the antenna support, so as to facilitate disposition of the antenna unit.

DESCRIPTION OF EMBODIMENTS

To make the objectives, technical solutions, and advantages of this application clearer, the following further describes this application in detail with reference to the accompanying drawings.

For ease of description, an antenna application scenario provided in embodiments of this application is first described. An antenna provided in the embodiments of this application is applied to a mobile terminal, for example, a common mobile terminal such as a notebook computer, a tablet computer, or a mobile phone. However, currently a mobile terminal is developing toward miniaturization. As a result, space for disposing the antenna becomes smaller, and an antenna array in the mobile terminal includes a plurality of antenna units. Consequently, a spacing between the antenna units becomes smaller, and interference between the antenna units is comparatively strong. To improve antenna performance, the embodiments of this application provide the antenna. The antenna includes a plurality of antenna units arranged in an array, and the antenna unit improves isolation between adjacent antennas by using a slot antenna and a linear antenna, to improve the antenna performance. The following describes in detail the antenna unit provided in the embodiments of this application with reference to the accompanying drawings and specific embodiments.

Figure 1:
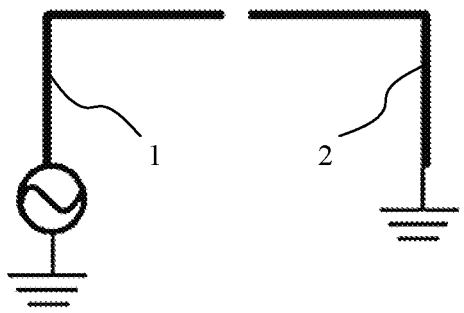
FIG. 1 is a schematic diagram of a structure of an MIMO antenna unit in the prior art.
Figure 2:
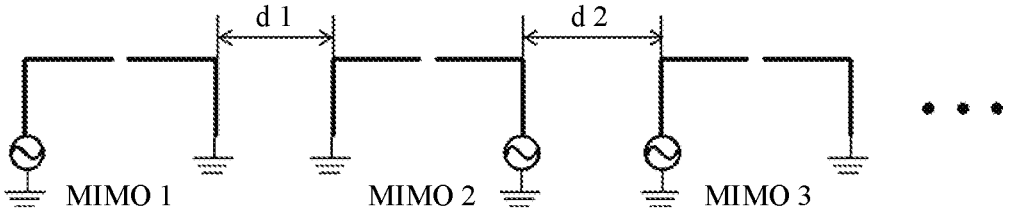
FIG. 2 is a schematic diagram of a structure of an MIMO system in the prior art.
Figure 3:
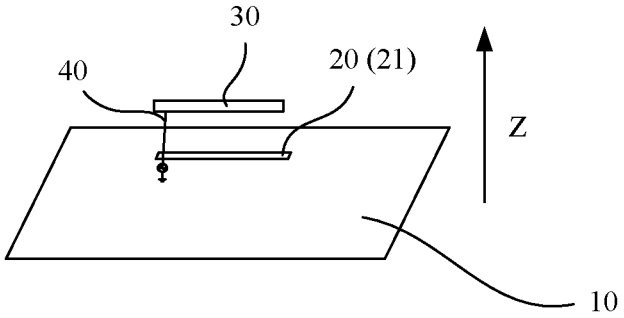
FIG. 3 is a schematic diagram of a structure of an antenna unit according to an embodiment of this application.

For ease of understanding the antenna provided in the embodiments of this application, the antenna unit provided in the embodiments of this application is first described in detail. FIG. 3 is a structure of the antenna provided in the embodiments of this application. In the structure shown in FIG. 3, the antenna unit provided in the embodiments of this application includes a slot antenna and a linear antenna. The slot antenna is coupled to the linear antenna. It should be understood that the coupling connection in the embodiments of this application is indirect coupling, and the indirect coupling is that two components are not directly connected but coupled by using an electromagnetic field or an electric field. The isolation between the two adjacent antenna units can be improved by using characteristics of the slot antenna and the linear antenna. During specific disposition, the slot antenna includes at least one first radiating element 20, the linear antenna includes at least one second radiating element 30, and only one of the slot antenna and the linear antenna feeds through a feeder 40. For example, when the feeder 40 is connected to the first radiating element 20, the feeder 40 is directly connected to the first radiating element 20, the slot antenna includes the first radiating element 20 and the feeder 40, and the linear antenna feeds by coupling the first radiating element 20 to the second radiating element 30, or when the feeder 40 is connected to the second radiating element 30, the feeder 40 is directly connected to the second radiating element 30, the linear antenna includes the second radiating element 30 and the feeder 40, and the slot antenna feeds by coupling the second radiating element 30 to the first radiating element 20. In specific use, in adjacent antenna units, the feeder 40 in the adjacent antenna units is connected to different radiating elements, to increase the isolation between the two adjacent antenna units. This further reduces a spacing between the antenna units, to reduce an area occupied by the antenna and facilitate the antenna developing toward miniaturization.

When the slot antenna and the linear antenna are specifically disposed, both the slot antenna and the linear antenna may use different structures. The following describes in detail structures of the slot antenna and the linear antenna provided in the embodiments of this application with reference to the accompanying drawings.

First, it should be noted that the mobile terminal provided in the embodiments of this application includes a middle frame and an antenna support. The middle frame is a frame between a front housing and a rear housing of the mobile terminal, and is configured to support an electrical component in the mobile terminal. When the antenna unit is disposed on the mobile terminal, the slot antenna may be disposed on the metal middle frame of the mobile terminal, and the linear antenna is correspondingly disposed on the antenna support of the mobile terminal. In this case, the antenna support is made of a non-conductive material. Certainly, alternatively, the slot antenna may be disposed on the antenna support, and the linear antenna may be disposed on the middle frame. In this case, the middle frame is made of a non-conductive material, and the antenna support is made of a conductive metal material. A schematic diagram of an antenna unit enumerated in the following embodiment is merely a simple schematic diagram of structures of a slot antenna and a linear antenna in the antenna unit, and does not represent an actual structure when the antenna unit is disposed in a mobile terminal.

Refer to FIG. 3. In the structure shown in FIG. 3, the slot antenna includes a first slot 21, and the linear antenna includes a radiating stub. In the structure shown in FIG. 3, the first slot 21 is a long strip-shaped slot. During disposition, the first slot 21 may be a slot with two closed ends, or may be a slot with an opening at one end. In the structure shown in FIG. 3, when the first slot 21 is disposed on the metal middle frame of the mobile terminal, the first slot 21 uses the slot with the two closed ends. This avoids forming an opening on a side edge of the middle frame, and improves an appearance of the mobile terminal. For a length of the first slot 21, in the structure shown in FIG. 3, the length of the first slot 21 is ½ of a wavelength corresponding to a fundamental mode, and the fundamental mode is a mode with the lowest frequency fed by a feedpoint. The first slot 21 may further be filled with an insulation layer whose dielectric constant is greater than air. The insulation layer may be a polycarbonate, an acrylonitrile-butadiene-styrene copolymer, and a mixture (a dielectric constant is 3.6, and a loss angle is 0.01). For slot antennas at a same frequency band, a larger dielectric constant of a filled material indicates a smaller slot size. Therefore, filling the first slot 21 with the insulation layer can effectively reduce the length of the first slot 21. For a loss angle of the insulation layer, a smaller loss angle of the insulation layer corresponds to better antenna performance.

Still referring to FIG. 3, the linear antenna includes the second radiating element 30 and the feeder 40. As shown in FIG. 3, the second radiating element 30 is a radiating element with a single radiating stub, and the feeder 40 is connected to the second radiating element 30. When the second radiating element 30 is specifically disposed, the second radiating element 30 is a metal sheet-like radiating element, and a specific structure of the second radiating element 30 may be a structure formed by a metal sheet or a metal wire. When the linear antenna and the slot antenna are specifically disposed, the slot antenna and the linear antenna are arranged along a Z direction, where the Z direction is a direction perpendicular to a metal plate 10 of the first slot 21. When the first slot 21 and the radiating stub are specifically disposed, a limitation may be imposed based on an actual situation, provided that coupling feeding can be implemented between the first slot 21 and the radiating stub. For example, different disposition manners, for example, a vertical projection of the radiating stub on the metal plate 10 partially or entirely overlaps with the first slot 21, or a vertical projection of the radiating stub on the metal plate 10 is located in the first slot 21, may be applied to the embodiments of this application. A vertical distance between the radiating stub and the first slot 21 may be adjusted based on an actual coupling effect.

Figure 4:
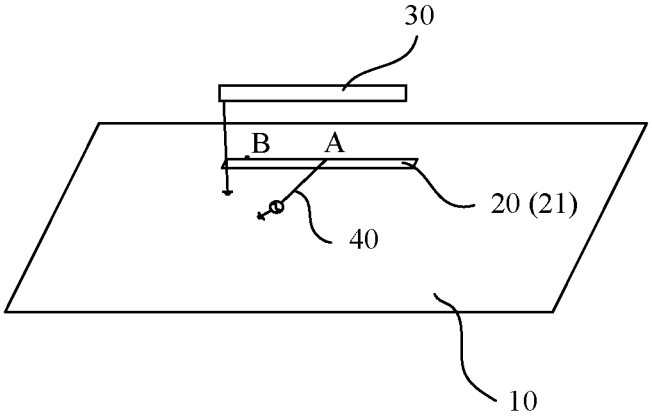
FIG. 4 is a schematic diagram of a structure of another antenna unit according to an embodiment of this application.

In the structure shown in FIG. 3, the feeder 40 is connected to the radiating stub. Certainly, the feeder 40 may also be connected to the first slot 21. As shown in FIG. 4, the slot antenna includes the first slot 21 and the feeder 40. When the first slot 21 is connected to the feeder 40, a side wall of the slot antenna is conductively connected to the feeder 40, a feeding position of the slot antenna is comparatively willingly determined, and the feeding position of the slot antenna may be at a center (a middle position of the first slot 21, a point A shown in FIG. 4), may also be disposed on a side (a position that is close to an end part on the first slot 21, for example, a point B shown in FIG. 4), or disposed between the point A and the point B. When the feeder 40 is disposed at the center, a ½ wavelength mode may be excited. In this case, the first slot 21 has a comparatively short length. When the feeder 40 is located near one end of the first slot 21, both the ½ wavelength mode and a 1× wavelength mode can be excited. However, in this case, compared with the first slot 21 that feeds at the point A, the first slot 21 that feeds at the point B has a comparatively long length, so as to excite the 1× wavelength mode.

Figure 5:
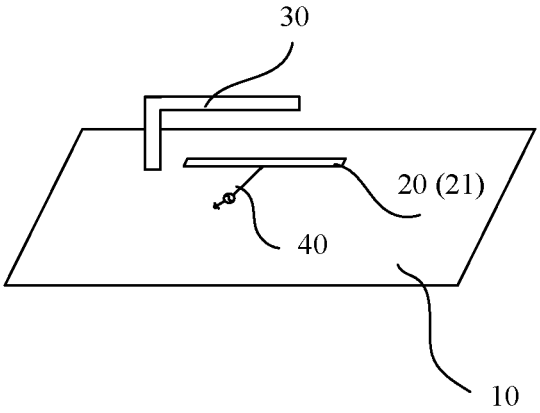
FIG. 5 is a schematic diagram of a structure of another antenna unit according to an embodiment of this application.
Figure 6:
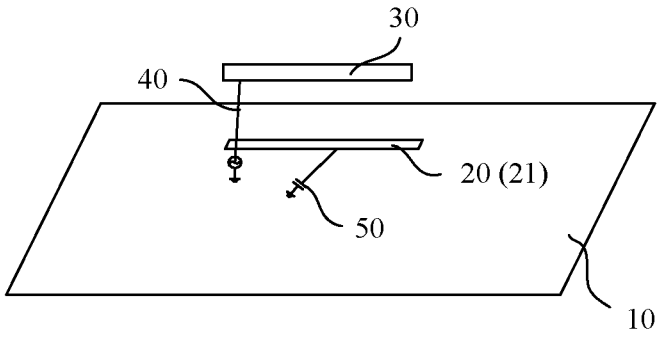
FIG. 6 is a schematic diagram of a structure of another antenna unit according to an embodiment of this application.

Regardless of which disposition manner in FIG. 3 or FIG. 4 is used, when the antenna unit is disposed in the mobile terminal, the linear antenna is disposed on the antenna support of a specific height, and the slot antenna is disposed on the middle frame. In a simplified design, when being used as a coupled antenna, a linear antenna may further be embedded in a ground structure. As shown in FIG. 5, in this case, a second radiating element 30 of the linear antenna is an inverted L-shaped bending structure, and a vertical part is connected to ground. In a structure shown in FIG. 5, a metal plate 10 of a first radiating element 20 is disposed as the ground. In this case, the second radiating element 30 is directly connected to the metal plate 10. As shown in FIG. 6, when a slot antenna is used as a coupled antenna, the slot antenna may be grounded by loading a capacitor 50, to reduce a slot size. In a same environment, compared with performance of an independent feeding linear antenna or an independent feeding slot antenna, performance of the slot antenna and the linear antenna in the antenna unit provided in this embodiment of this application is greatly improved.

Figure 7:
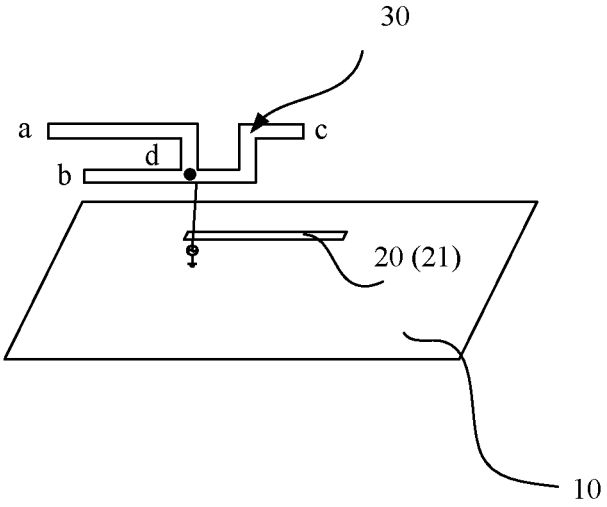
FIG. 7 is a schematic diagram of a structure of another antenna unit according to an embodiment of this application.
Figure 8:
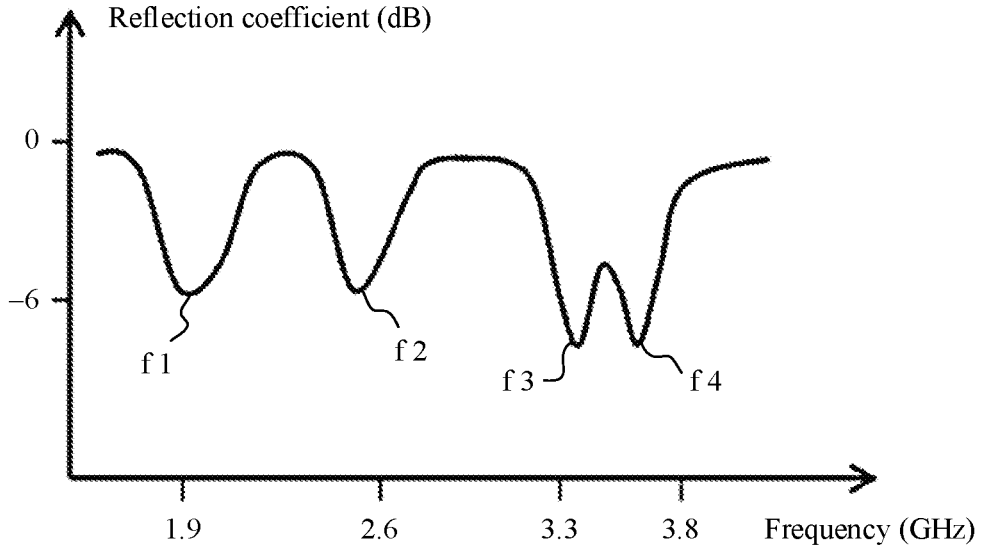
FIG. 8 shows a reflection coefficient curve of the antenna unit shown in FIG. 7 according to an embodiment of this application.

In addition, to improve antenna adaptability, when the second radiating element 30 is specifically disposed, the second radiating element 30 may include a plurality of radiating stubs, and operating frequencies of the plurality of radiating stubs are different. During specific disposition, the electrical lengths between the plurality of radiating stubs are different, and when the radiating stub is made of a metal sheet or a metal wire, the electrical length may be reflected by using different lengths of the metal sheet or the metal wire. When being coupled to the first slot 21, the first slot 21 is coupled to at least one radiating stub. The following uses an example in which the second radiating element 30 has four radiating stubs for description. FIG. 7 shows a structure in which a second radiating element 30 has four radiating stubs. A first slot 21 is coupled to two of the radiating stubs. The four radiating stubs are a radiating stub ad, a radiating stub bd, a radiating stub cd, and a radiating stub cb respectively. When the four radiating stubs are specifically disposed, the four radiating stubs respectively correspond to different operating frequencies. Specifically, referring to FIG. 8, a resonance f 1 is generated in a ¼ wavelength mode of the radiating stub ad, and a length of the radiating stub ad is ¼ of a wavelength corresponding to the resonance f 1. A resonance f 2 is generated in a ¼ wavelength mode of the radiating stub bd, and a length of the radiating stub bd is ¼ of a wavelength corresponding to the resonance f 2. A resonance f 3 is generated in a ½ wavelength mode of the radiating stub bc and a ½ wavelength mode of the first slot 21, and in this case, a length of the radiating stub bc is related to both ½ of a wavelength corresponding to the resonance f 3 and ½ of a wavelength of a fundamental mode of the first slot 21, and the length of the radiating stub bc is adjusted by using an experiment, so that the radiating stub bc can work at a frequency f 3. A resonance f 4 is generated when a ¼ wavelength mode of a radiating stub cd is coupled to the ½ wavelength mode of the first slot 21, a length of the radiating stub cd is related to ½ of a wavelength corresponding to the resonance f 4 and ½ of the wavelength of the fundamental mode of the first slot 21, and the length of the radiating stub cd was adjusted by using an experiment. It can be learned from FIG. 7 and FIG. 8 that, the second radiating element 30 is disposed with a plurality of radiating stubs, to widen an operating frequency band of an entire antenna unit, and form a wideband or multi-band antenna.

Figure 9:
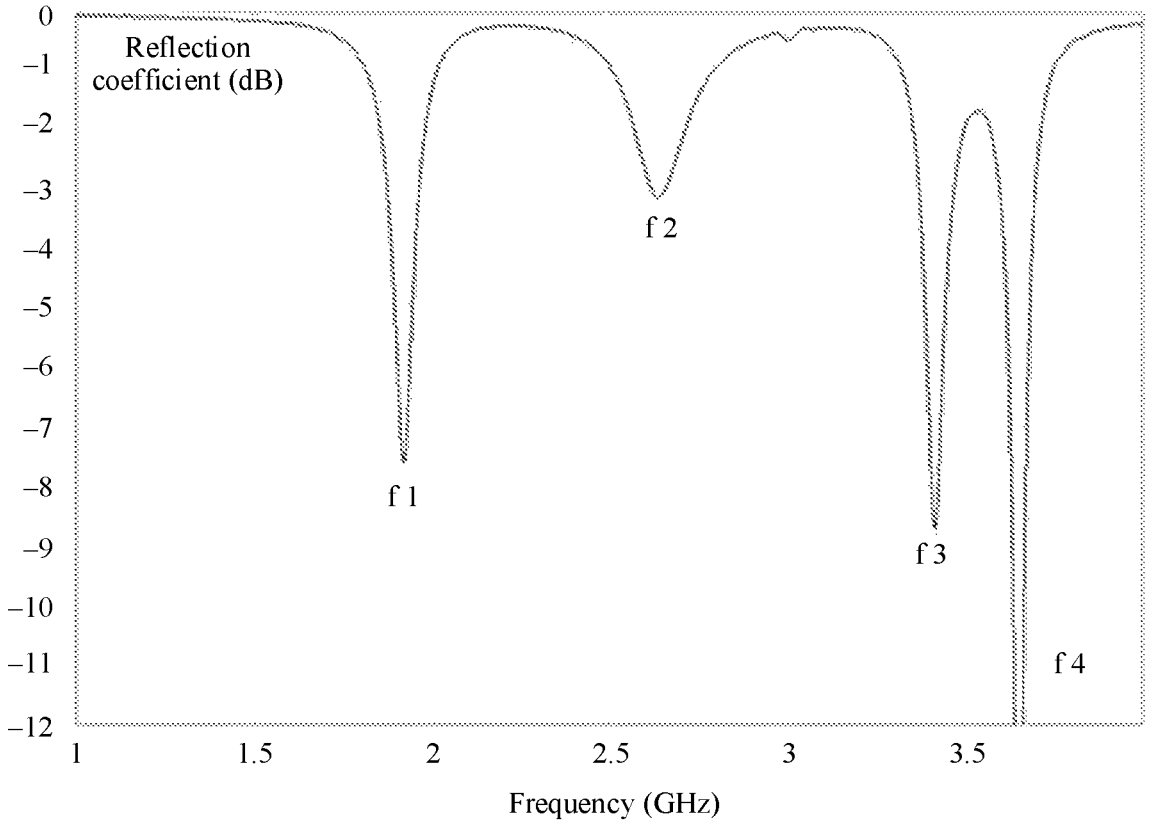
FIG. 9 shows a reflection coefficient curve of the antenna unit shown in FIG. 7 during simulation according to an embodiment of this application.
Figure 10A:
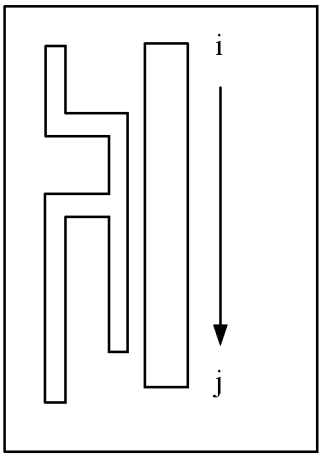
FIG. 10*a* to FIG. 10*d* are schematic diagrams of currents of a slot antenna according to an embodiment of this application.
Figure 10B:
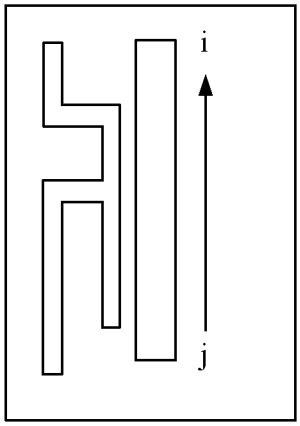
Figure 10C:
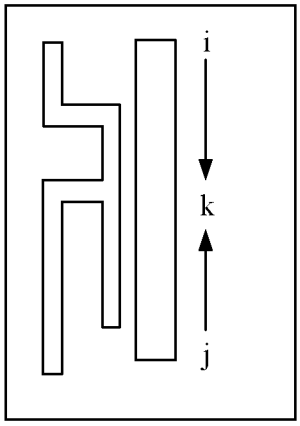
Figure 10D:
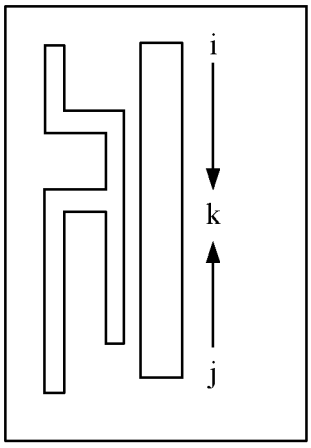

For ease of understanding an antenna unit provided in this embodiment of this application, the following performs simulation by using the structure shown in FIG. 7. Frequency bands of the simulation are design as B3 (1805 MHz-1880 MHz), B1 (2110 MHz-2170 MHz), B41 (2496 MHz-2690 MHz), B42 (3400 MHz-3600 MHz), and B43 (3600 MHz-3800 MHz). A linear antenna has a feedpoint and a ground point. A coupled slot antenna is grounded by loading a capacitor 50. A resonance frequency corresponding to the slot antenna is about 3.5 GHz. The linear antenna has four (which may be considered as four, but a, b, c, d, and the like are unmarked in the figure) radiating stubs of different lengths. FIG. 9 shows a resonance excited by an antenna unit. Two lower resonances are generated by the radiating stub ab and the radiating stub bd in the linear antenna, and are used to cover frequency bands B3, B1, and B41 MIMO. Two higher resonances are generated by coupling the radiating stub bc, the radiating stub cd, and the slot antenna, and are used to cover frequency bands B42 and B43 MIMO. FIG. 10*a* to FIG. 10*d* show current distribution in different resonances. It can be seen from a flow direction of a slot current that all the four frequency bands excite a slot antenna mode. In the figure, a straight line with an arrow represents a flow direction of a current, where i and j represent endpoints on a first slot 21, and k is a ground point of a capacitor 50 of the first slot 21. It can be seen from FIG. 10*a* that, at a frequency f 1, the current flows from the point i to the point j of the slot antenna. It can be seen from FIG. 10*b* that, at a frequency f 2, the current flows from the point j to the point k. It can be seen from FIG. 10*c* that, at a frequency f 3, the current flows from the point i to the point k, and flows from the point j to the point k of the slot antenna. It can be seen from FIG. 10*d* that, at a frequency f 4, the current flows from the point i to the point k, and flows from the point j to the point k of the slot antenna. It can be seen from FIG. 8 and FIG. 9 that, through the antenna simulation, a simulation effect is similar to a design effect, to implement a function of a broadband or multi-band antenna.

Figure 11:
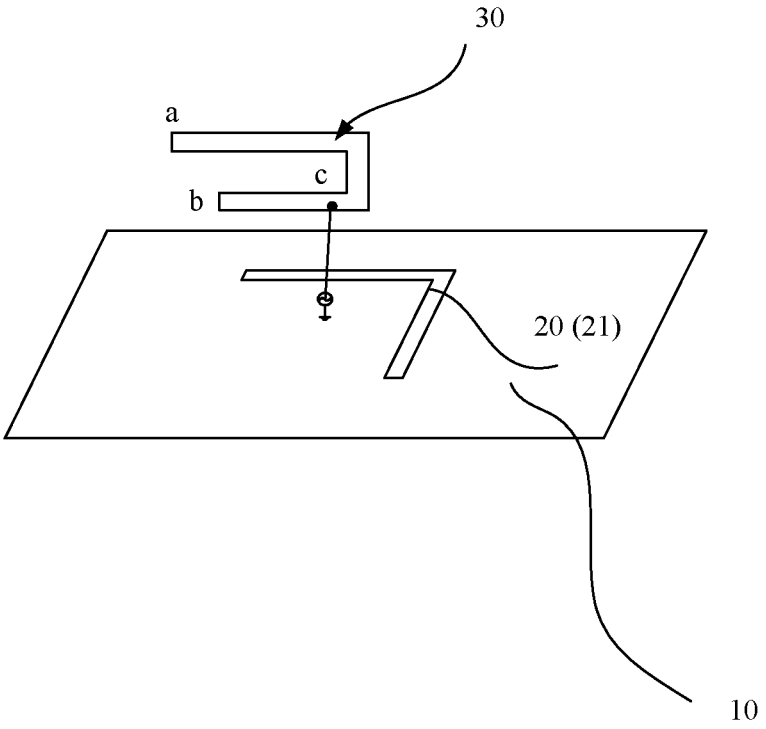
FIG. 11 is a schematic diagram of a structure of another antenna unit according to an embodiment of this application.

When a plurality of antenna units are used to form an antenna array, a design area of the antenna units is further compressed. In this embodiment of this application, as shown in FIG. 11, a slot antenna and a linear antenna are bent to further reduce an area of an antenna unit. During specific disposition, a first radiating element 20 and a second radiating element 30 are disposed in a bending manner. For example, only the first slot 21 may be bent, only the radiating stub may be bent, or both the first slot 21 and a radiating stub may be bent. When the first slot 21 is specifically bent, the first slot 21 may be bent into an L-shaped slot or a C-shaped slot. Similarly, when the radiating stub is bent, the radiating stub may also be bent into an L shape or a C shape. However, it should be understood that regardless of which bending manner is used, coupling between the first slot 21 and the radiating stub should be implemented. FIG. 11 shows a specific bending manner of a first slot 21 and a radiating stub. The first slot 21 shown in FIG. 11 is bent in an L shape, and the radiating stub is bent in a C shape. When this bending manner is used, a space area occupied by an entire antenna unit can be effectively improved. When the antenna unit is specifically disposed and when the first slot 21 is located on an edge of a middle frame, the first slot 21 can be disposed by using an edge at a corner of the middle frame. It should be understood that when the radiating stub is bent, the radiating stub may be equivalent to a plurality of stubs. As shown in FIG. 11, a bent radiating stub may be equivalent to the radiating stub ab, the radiating stub ac, and the radiating stub bc.

Figure 12:
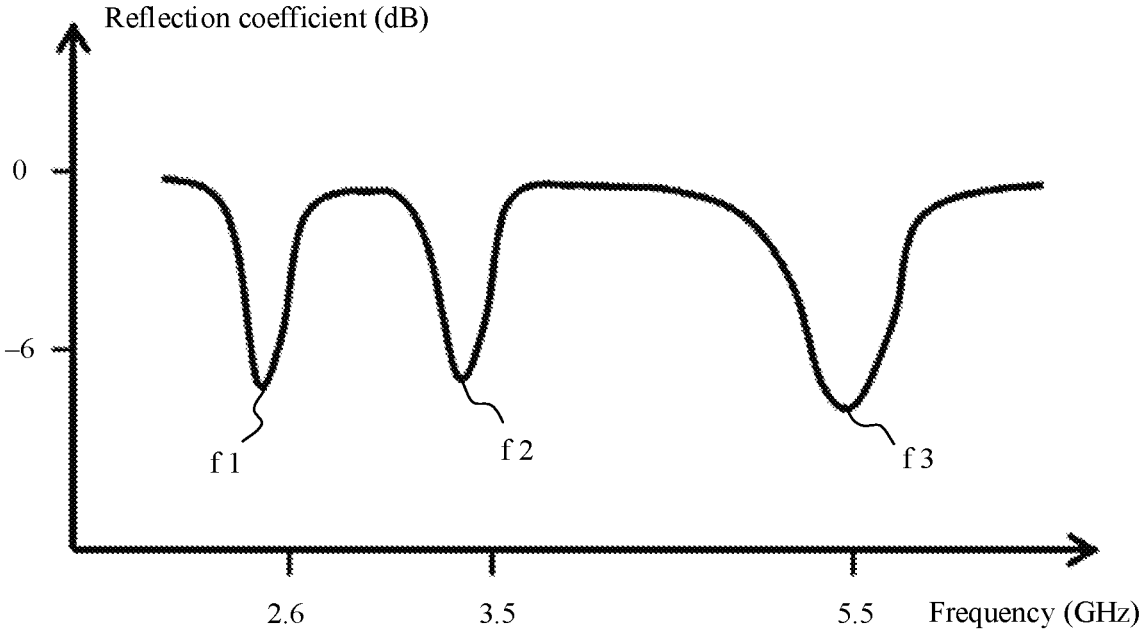
FIG. 12 shows a reflection coefficient curve of the antenna unit shown in FIG. 11 according to an embodiment of this application.

In a specific embodiment, as shown in FIG. 11, a linear antenna is a coupled antenna, has two radiating stubs, and a bent slot antenna feedpoint deviates from a middle position. FIG. 12 is a schematic diagram of an antenna reflection coefficient curve. A resonance f 1 is generated when a ¼ wavelength mode of a radiating stub ac is coupled to a ½ wavelength mode of a slot antenna, a length of the radiating stub ac is related to ¼ of a wavelength corresponding to the resonance f 1 and ½ of a wavelength of a fundamental mode of a first slot 21, and the length of the radiating stub ac is adjusted by using an experiment, so that the radiating stub bc can work at a frequency f 1. A resonance f 2 is generated when a ½ wavelength mode of a radiating stub ab is coupled to a ½ wavelength mode of the slot antenna, and a length of the radiating stub ab is related to ½ of a wavelength corresponding to the resonance f 2 and ½ of a wavelength of a fundamental mode of the first slot 21, and a length of the radiating stub bc is adjusted by using an experiment, so that the radiation stub bc can work at a frequency f 2. A resonance f 3 is generated when a ¼ wavelength mode of a radiating stub bc is coupled to a 1× wavelength mode of the slot antenna, a length of the radiating stub bc is related to ½ of a wavelength corresponding to the resonance f 3 and a 1× wavelength mode of a fundamental mode of the first slot 21, and the length of the radiating stub bc is adjusted based on an experiment, so that the radiating stub bc can work at a frequency f 3.

Figure 13:
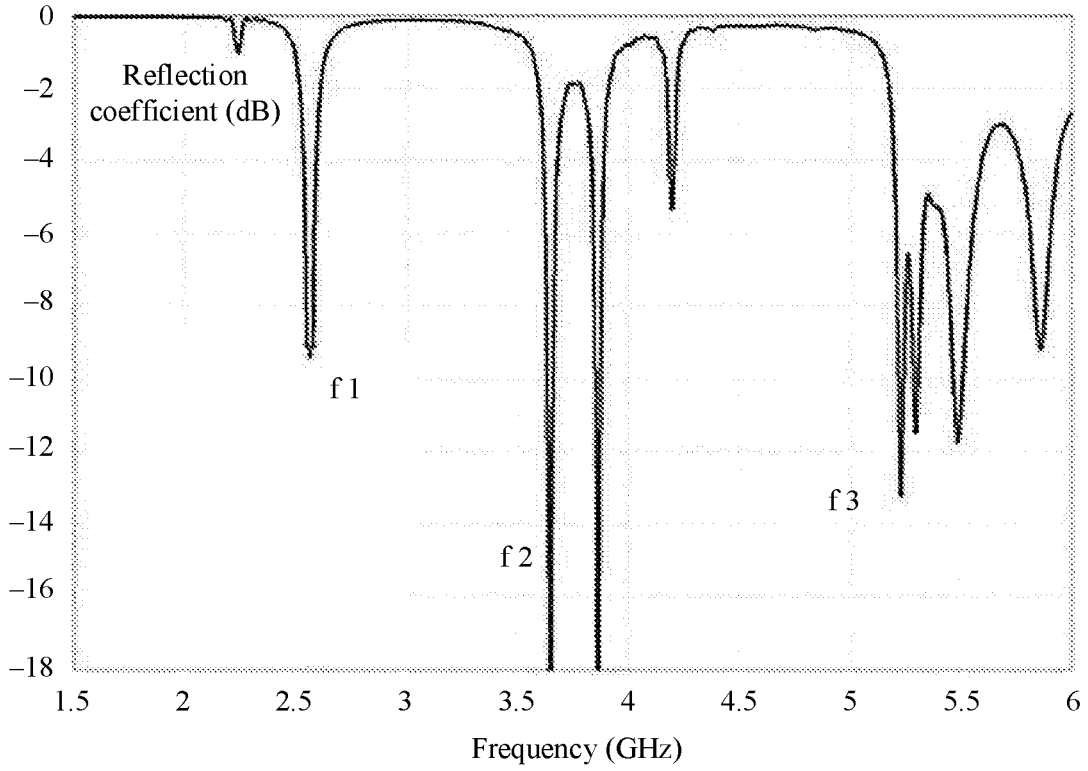
FIG. 13 shows a reflection coefficient curve of the antenna unit shown in FIG. 11 during simulation according to an embodiment of this application.
Figure 14A:
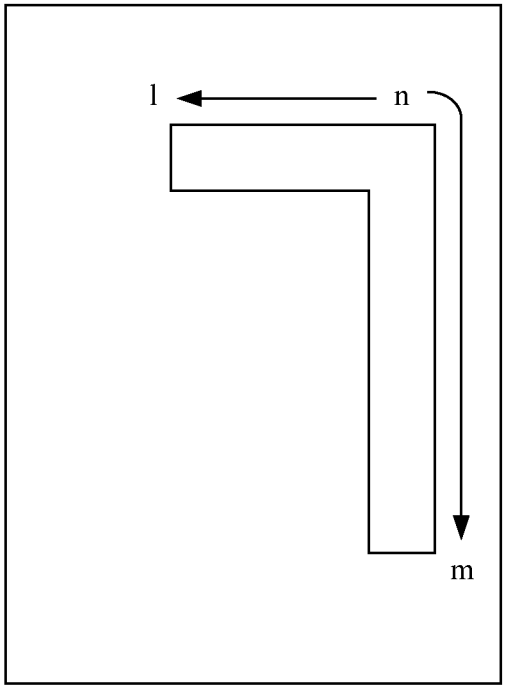
FIG. 14*a* to FIG. 14*c* are schematic diagrams of currents of a slot antenna according to an embodiment of this application.
Figure 14B:
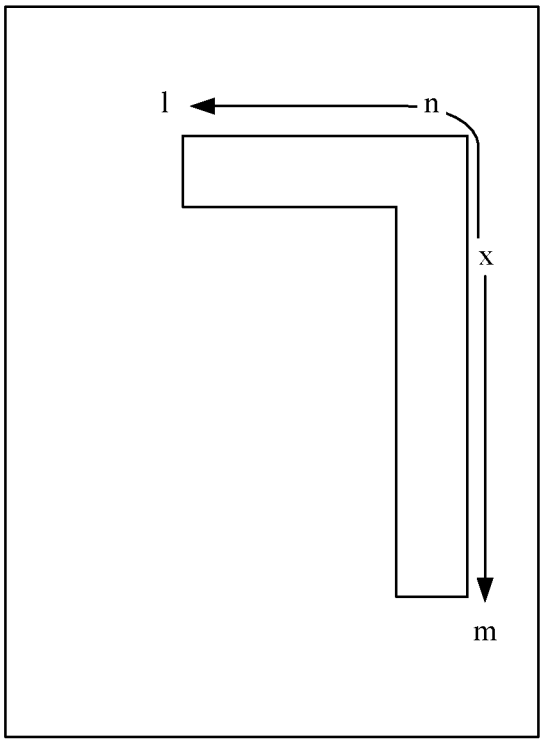
Figure 14C:
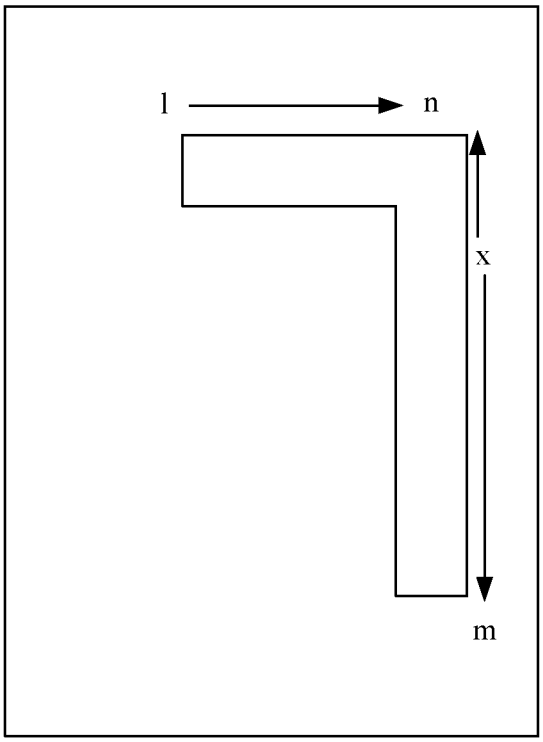

Simulation is performed on the antenna unit provided in FIG. 11. Frequency bands of the antenna unit are designed as B41, B42, and 5 GHz Wi-Fi MIMO. The slot antenna is connected to a feeder 40, and a linear antenna is coupled to the slot antenna and directly grounded. A resonance frequency of the ½ wavelength of the slot antenna is about 2.6 GHz, and the linear antenna has three radiating stubs. FIG. 13 shows current and electric field distribution of three resonance points. The lowest resonance is generated when a ¼ wavelength mode of the radiating stub ac is coupled to a ½ wavelength mode of a slot antenna, and may cover a frequency band B41 MIMO. An intermediate resonance is generated when a ½ wavelength mode of the radiating stub ab is coupled to the ½ wavelength mode of the slot antenna, and can cover a frequency band B42 MIMO. The highest resonance is generated when a ¼ wavelength mode of the linear radiating stub bc is coupled to the 1× wavelength mode of the slot antenna, and can cover a frequency band 5 GHz MIMO. FIG. 14*a* to FIG. 14*c* show current distribution in different resonances. In the figure, a straight line with an arrow represents a flow direction of a current, l and m represent endpoints on a first slot 21, and n and x are middle points of the first slot 21. It can be seen from FIG. 14*a* that, at a frequency f 1, the current flows from the point n to the point 1 and from the point n to the point m of a slot antenna. It can be seen from FIG. 14*b* that, at a frequency f 2, the current flows from the point x to the point 1 and from the point x to the point m. It can be seen from FIG. 14*c* that, at a frequency f 3, the current flows from the point 1 to the point n, from the point x to the point n, and from the point x to the point m of the slot antenna. It can be seen from FIG. 12 and FIG. 13 that, through the antenna simulation, a simulation effect is similar to a design effect, to implement a function of a broadband or multi-band antenna.

Figure 15:
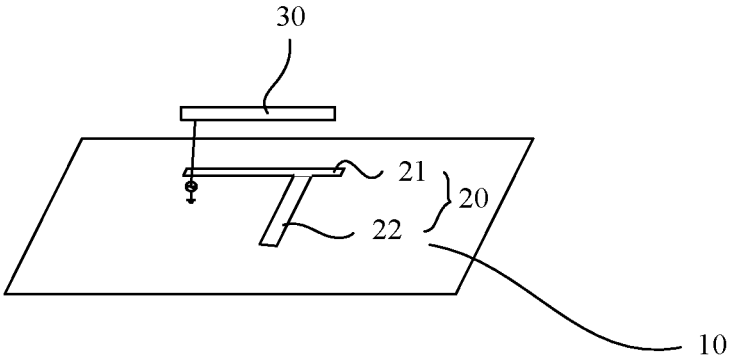
FIG. 15 is a schematic diagram of a structure of another antenna unit according to an embodiment of this application.

When performance of the antenna is extended, in addition to the foregoing manner of adding the radiating stub of the second radiating element 30, a manner of improving a structure of the first radiating element 20 is further used. As shown in FIG. 15, other than the first slot 21 disposed at the metal layer, the slot antenna further includes a second slot 22 connected to the first slot 21. When the second slot 22 is disposed, the second slot 22 is coupled to at least one radiating stub of the second radiating element 30. Specifically, a coupling relationship between the second slot 22 and the radiating stub is similar to a coupling relationship between the first slot 21 and the radiating stub. Details are not described herein again. When the second slot 22 is specifically disposed, there may be one or two or more second slots 22, operating frequencies of the first slot 21 and the second slot 22 are disposed differently, and when there are a plurality of second slots 22, operating frequencies of the plurality of second slots 22 are also different.

Figure 16:
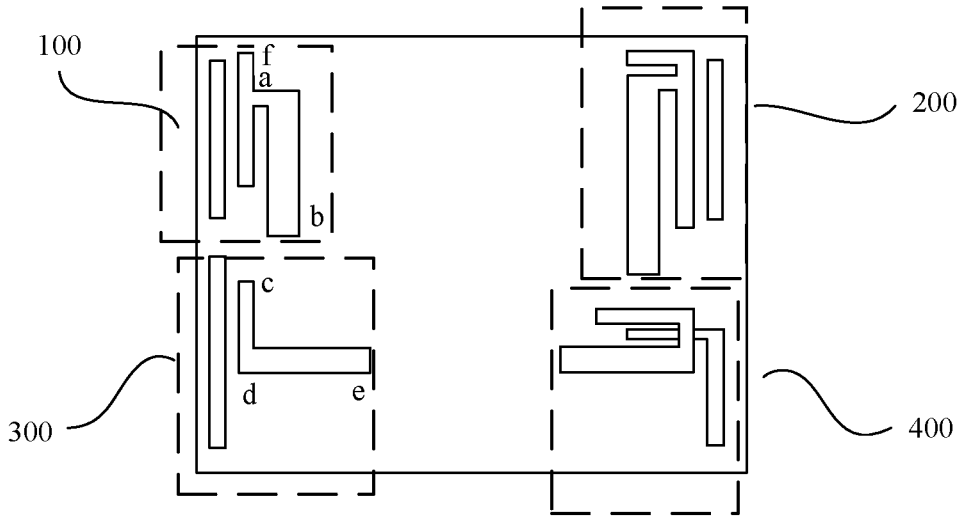
FIG. 16 is a schematic diagram of a structure of an antenna system according to an embodiment of this application.

The antenna unit may be applied to a multi-band MIMO antenna array. Specifically, the antenna array includes: any one of the antenna units arranged in an array; and in any two adjacent antenna units, a feeder 40 of one antenna unit is connected to the first radiating element 20, and a feeder 40 of the other antenna unit is connected to the second radiating element 30. In a specific implementation solution, a quantity of the antenna units is an even number, and the even number of antenna units are arranged side by side in two rows. In each row of antenna units, operating frequencies corresponding to two adjacent first slots are different, and operating frequencies of two radiating stubs with a minimum spacing in two adjacent second radiating elements are different. FIG. 16 shows a schematic diagram with four antenna units. The four antenna units are a first antenna unit 100, a second antenna unit 200, a third antenna unit 300, and a fourth antenna unit 400 respectively. A placement direction of an antenna array shown in FIG. 16 is used as a reference direction. The first antenna unit 100 and the second antenna unit 200 are located in a same line, and the third antenna unit 300 and the fourth antenna unit 400 are located in a same line. The first antenna unit 100 and the third antenna unit 300 are located in a same row, the second antenna unit 200 and the fourth antenna unit 400 are located in a same row, and the two rows of antenna units are arranged on two sides of a mobile terminal separately. As shown in FIG. 16, the first antenna unit 100 and the third antenna unit 300 are two adjacent antennas, and the second antenna unit 200 and the fourth antenna unit 400 are two adjacent antennas. During specific disposition, the first antenna unit 100 and the second antenna unit 200 are in a manner in which a linear antenna is connected to a feeder 40, and a slot antenna is coupled to the linear antenna. Second radiating elements 30 of both the first antenna unit 100 and the second antenna unit 200 include a plurality of radiating stubs. The slot antennas in the first antenna unit 100 and the second antenna unit 200 are grounded by loading a capacitor 50, to reduce a reduced size of the slot antenna. The third antenna unit 300 and the fourth antenna unit 400 are in a manner in which a slot antenna is connected to a feeder 40, and a linear antenna is coupled to the slot antenna. A slot of the slot antenna in the fourth antenna unit 400 is a bent slot, to reduce a space area occupied by the slot antenna. According to operating characteristics of the linear antenna and the slot antenna, good isolation and radiation characteristics (orthogonal polarization directions) of the linear antenna and the slot antenna can be obtained in this case. Therefore, compared with that of an antenna in the prior art, an occupied space area can be reduced.

For the antenna shown in FIG. 16 provided in this embodiment of this application, to improve the isolation between two adjacent antenna units, for the two adjacent antenna units, the isolation between the antenna units may be improved in the following manner.

As shown in FIG. 16, in addition to the design in which the feeder is connected to each of the first radiating element and the second radiating element, differentiated designs may further be existed in the first slots in the adjacent antenna units, for example, a design in which lengths of the first slots are disposed differently, so that the first slot of the two antenna units works at different frequencies, and in other words, so that the electrical lengths of the two adjacent first slots are different. As shown in FIG. 16, a length of a first slot of the first antenna unit 100 is comparatively short and the first slot works at a high frequency, and a length of a first slot of the third antenna unit 300 is comparatively long and the first slot works at a low frequency. In addition to the manner in which lengths of the first slots are changed, a manner in which an electrical length of the first slot may be changed by filling an insulation layer, for example, filling the insulation layer in the first slot of the third antenna unit 300, or configuring a capacitor during grounding, so that the length of the first slot is reduced, and the length of the first slot is approximate to the length of the first slot of the first antenna unit 100. However, in this case, an operating frequency band of the first slot of the third antenna unit 300 is still different from an operating frequency band of the first slot of the first antenna unit 100.

Differentiated designs may further be existed in adjacent linear antennas, for example, operating frequencies of two radiating stubs with a minimum spacing in adjacent second radiating elements are different. During specific disposition, lengths of radiating stubs that are relatively close to each other in the two antenna elements are different, for example, a radiating stub ab in the first antenna unit 100 is a long stub, whose operating frequency band is near a low frequency, and a radiating stub cd that is in the third antenna unit 300 and that is the closest to the radiating stub ab is a short stub, and a frequency band in which the radiating stub cd participates is near a high frequency, to cover different frequency bands. In this manner, adjacent radiating stubs work in different frequency bands, to improve isolation between two antenna units.

Alternatively, for radiating stubs that are in the two adjacent antenna units and that work in a same frequency band, during disposition, an interval between the radiating stubs operating at the same frequency is greater than a specified value, where the specified value may be limited according to an actual requirement, to increase the interval between the radiating stubs operating at the same frequency, and avoid coupling between the two radiating stubs operating at the same frequency length. For example, both the radiating stub ab and a radiating stub ce function in a low frequency band. However, because a spacing between the two radiating stubs is comparatively large, a distance between the two radiating stubs can ensure good isolation and a good ECC (Envelope Correlation Coefficient, envelope correlation coefficient).

For radiating elements that are in the two adjacent antenna units and that work in a same frequency band, radiators may be separately designed by using the closest slot antenna and linear antenna. For example, both the first slot and the radiating stub cd in the first antenna unit 100 function in the high frequency band, or a first slot and the radiating stub ab of the second antenna function in the low frequency band. In this case, the good isolation and the good ECC can still be obtained based on a radiation characteristic (an orthogonal polarization direction) of the slot antenna and the linear antenna.

Figure 17:
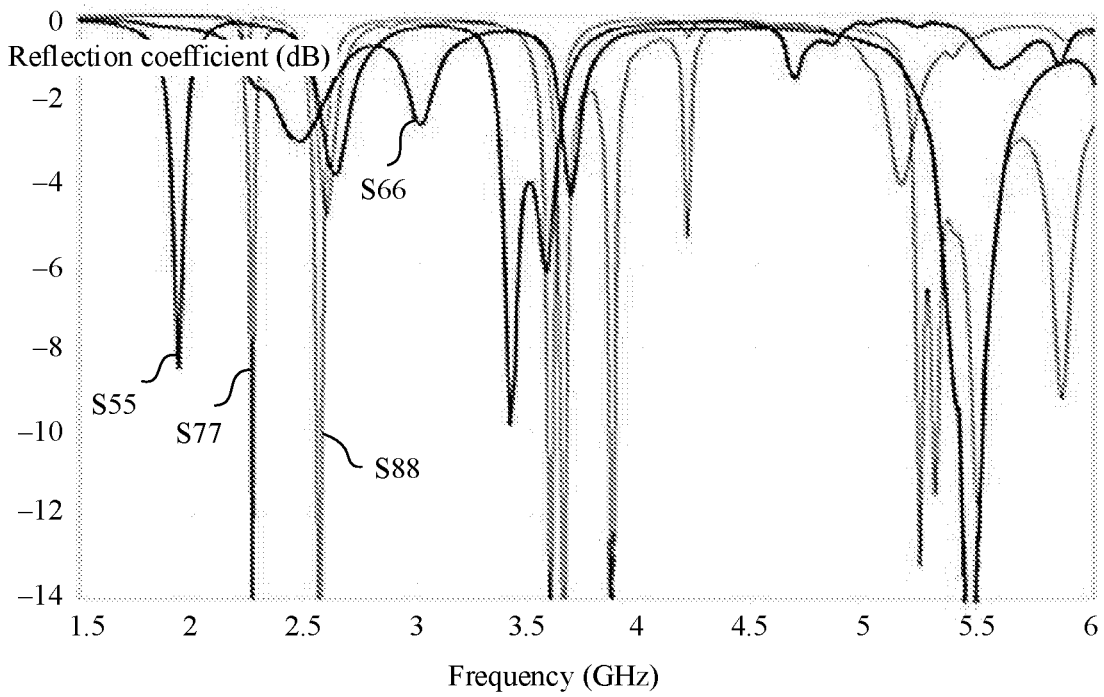
FIG. 17 is a schematic simulation diagram of an antenna system according to an embodiment of this application.
Figure 18:
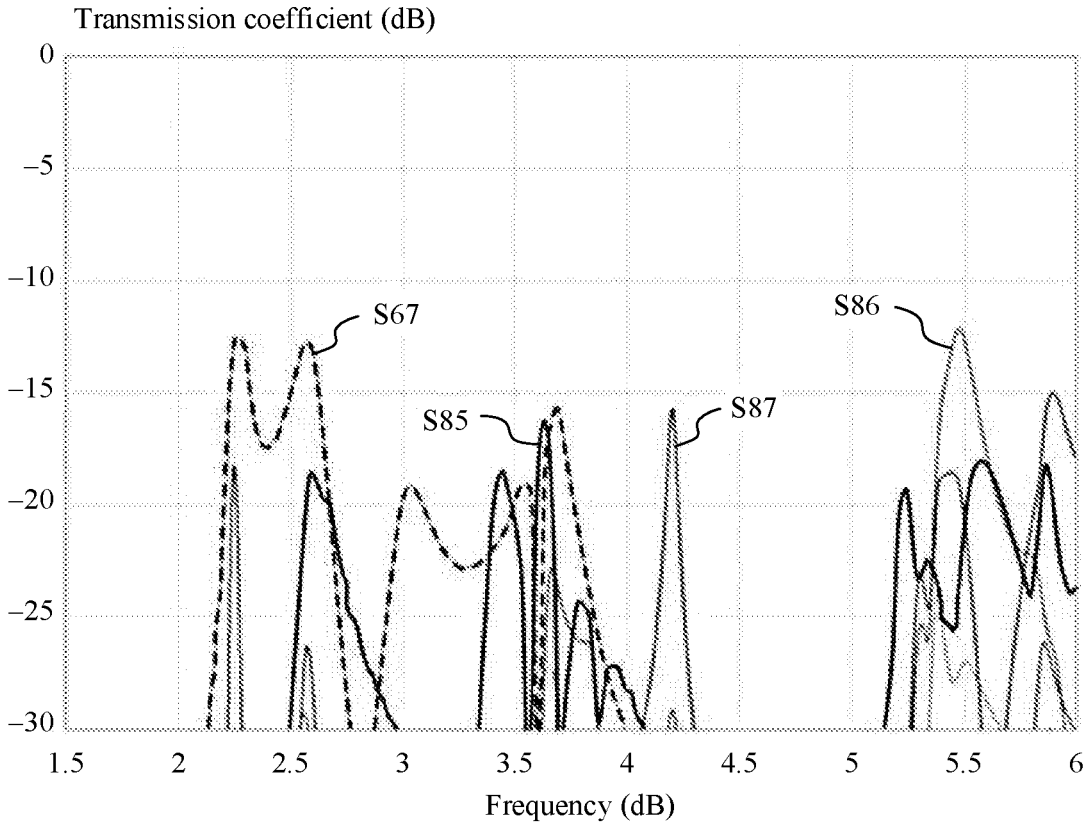
FIG. 18 is a schematic simulation diagram of isolation of an antenna system according to an embodiment of this application.

For ease of understanding, the following provides a description through simulation. The antenna which is designed mainly covering frequency bands B41 and B42 in the foregoing method is used as a simulation object. FIG. 17 shows a simulation model and reflection coefficient curves of four antennas. S55, S66, S77, and S88 represent a reflection coefficient of each of a first antenna unit 100, a second antenna unit 200, a third antenna unit 300, and a fourth antenna unit 400. The second antenna unit 200 is in a form of coupling a feeding multi-stub antenna to a slot antenna, and coverage frequency bands of the second antenna unit 200 include B3, B1, B41, and B42 MIMO. For details, refer to the description of the multi-radiating stub in the foregoing example. A structure of the first antenna unit 100 is similar to that of the second antenna unit 200, and coverage frequency bands of the first antenna unit 100 include Wi-Fi 2.4/5 GHz, B41, and B42 MIMO, where the 5 GHz mode is generated only in a ¼ wavelength mode of the shortest radiating stub of in a linear antenna. The fourth antenna unit 400 is in a form of coupling a bent slot antenna through feeding to a linear antenna, coverage frequency bands of the fourth antenna unit 400 include B41, B42, and a Wi-Fi 5 GHz MIMO, a resonance mode of the fourth antenna unit 400 is described above. A form of the third antenna unit 300 is similar to that of the fourth antenna unit 400, but a slot antenna of the third antenna unit 300 is not bent, and coverage frequency bands of the third antenna unit 300 include B41, B42 MIMO, and the like. It should be noted that, a minimum distance between antennas is only 4 mm between the first antenna unit 100 and the third antenna unit 300, and a distance between the second antenna unit 200 and the fourth antenna unit 400 is also 4 mm. FIG. 18 shows an isolation curve between antenna units. For example, S56 represents a transmission coefficient between the second antenna unit 200 and the first antenna unit 100, and S87 represents a transmission coefficient between the third antenna unit 300 and the fourth antenna unit 400. In an engineering field, a transmission coefficient less than −10 dB (isolation is greater than 10 dB) usually meets a requirement. In FIG. 18, a maximum transmission coefficient is about −12 dB (a maximum value at S67 is −8 dB but is not within a designed frequency band). Isolation is greater than 12 dB in frequency bands B3, B1, B41, B42, and 5 GHz MIMO.

Figure 19:
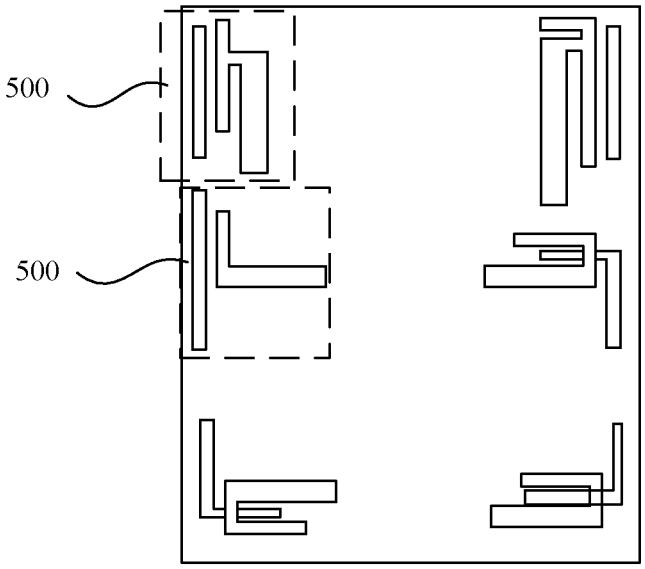
FIG. 19 is a schematic diagram of another antenna structure according to an embodiment of this application.

Certainly, only an antenna system using the four antenna units is listed in the foregoing embodiment. In this embodiment of this application, the provided antenna system may further include any other quantity of antenna systems, for example, two, five, six, or eight antenna units. FIG. 19 shows an antenna using six antenna units 500.

It can be learned from the foregoing description that, in this embodiment of this application, when an antenna unit form an antenna system, adjacent antenna units are designed differently. Slot antennas including the adjacent antenna units are designed for feeding and coupling separately, and designed lengths are different. Linear antennas of the adjacent antenna units are designed for feeding and coupling separately, and lengths of stubs that are the nearest with each other are different. The adjacent antenna units function in a same frequency band and radiators may be separately designed by using the closest slot antenna and linear antenna. A stub of the linear antenna (or the slot antenna) in which the adjacent antenna units function on a same frequency band is designed at a far-away position. The differentiated design can still achieve good isolation and a good ECC when distance between MIMO units is short. According to the foregoing design, the antenna provided in this embodiment of this application can reduce a spacing between the adjacent antenna units, to reduce a space area occupied by the antenna.

An embodiment of this application further provides a terminal. The mobile terminal may be a common mobile terminal such as a mobile phone, a tablet computer, or a notebook computer. The mobile terminal includes the antenna unit according to any one of the foregoing or the antenna array according to any one of the foregoing.

A housing, a middle frame disposed in the housing, and an antenna support disposed in a stacked manner with the middle frame are disposed in the mobile terminal. When the antenna is specifically disposed, the first radiating element is disposed on the middle frame, and the second radiating element is disposed on the antenna support. For a specific disposition manner, refer to the description in the foregoing antenna unit example.

In the foregoing technical solution, feeders in adjacent antenna units are directly connected to different first radiating elements and second radiating elements. Therefore, isolation between the two adjacent antenna units is increased, and space occupied by the antenna is reduced.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An antenna, comprising a plurality of antenna units arranged in an array, wherein each antenna unit comprises:

a first radiating element and a second radiating element, wherein the first radiating element is a first slot disposed inside a metal layer, the second radiating element is a metal sheet-like radiating element, the second radiating element comprises at least one radiating stub, and the first slot is coupled to the at least one radiating stub, wherein the metal layer is a metal plate that includes the first slot, and wherein the second radiating element is not connected to the first radiating element and is coupled to the first radiating element by using an electromagnetic field or an electric field; and each antenna unit further comprises a feeder, and in any two adjacent antenna units, a feeder of one antenna unit is connected to a first radiating element of the antenna unit, and a feeder of the other antenna unit is connected to a second radiating element of the antenna unit.

2. The antenna according to claim 1, wherein in any two adjacent antenna units, operating frequencies corresponding to two adjacent first slots are different, and in any two adjacent antenna units, operating frequencies of two radiating stubs with a minimum spacing in adjacent second radiating elements are different.

3. The antenna according to claim 2, wherein in any two adjacent antenna units, a spacing between radiating stubs operating at a same frequency is greater than a specified value.

4. The antenna according to claim 2, wherein a quantity of the antenna units is an even number, and the even number of the antenna units are arranged side by side in two rows.

5. The antenna according to claim 1, wherein at least one of the radiating stubs of the second radiating element is a bent radiating stub.

6. The antenna according to claim 1, wherein when the second radiating element comprises two or more radiating stubs, operating frequencies of the two or more radiating stubs are different.

7. The antenna according to claim 1, wherein the first slot of the first radiating element is a bent slot.

8. The antenna according to claim 1, wherein an insulation layer is disposed in the first slot of the first radiating element.

9. The antenna according to claim 1, wherein when the second radiating element is connected to the feeder, a side wall of the first slot is grounded by using a capacitor; and when the first radiating element is connected to the feeder, the metal layer is a ground plane, and the second radiating element is connected to the metal layer.

10. The antenna according to claim 1, wherein the first radiating element further comprises a second slot that is disposed at the metal layer and that is connected to the first slot, and the second slot is coupled to the at least one of the radiating stubs of the second radiating element.

11. A mobile terminal, comprising a plurality of antenna units arranged in an array, wherein each antenna unit comprises:

a first radiating element and a second radiating element, wherein the first radiating element is a first slot disposed inside a metal layer, the second radiating element is a metal sheet-like radiating element, the second radiating element comprises at least one radiating stub, and the first slot is coupled to the at least one radiating stub, wherein the metal layer is a metal plate that includes the first slot, and wherein the second radiating element is not connected to the first radiating element and is coupled to the first radiating element by using an electromagnetic field or an electric field; and each antenna unit further comprises a feeder, and in any two adjacent antenna units, a feeder of one antenna unit is connected to a first radiating element of the antenna unit, and a feeder of the other antenna unit is connected to a second radiating element of the antenna unit.

12. The mobile terminal according to claim 11, further comprising a housing, a middle frame disposed in the housing, and an antenna support disposed in a stacked manner with the middle frame, wherein the first radiating element is disposed on the middle frame, and the second radiating element is disposed on the antenna support.

13. The mobile terminal according to claim 12, wherein in any two adjacent antenna units, a spacing between radiating stubs operating at a same frequency is greater than a specified value.

14. The mobile terminal according to claim 12, wherein a quantity of the antenna units is an even number, and the even number of the antenna units are arranged side by side in two rows.

15. The mobile terminal according to claim 11, wherein in any two adjacent antenna units, operating frequencies corresponding to two adjacent first slots are different, and in any two adjacent antenna units, operating frequencies of two radiating stubs with a minimum spacing in adjacent second radiating elements are different.

16. The mobile terminal according to claim 11, wherein at least one of the radiating stubs of the second radiating element is a bent radiating stub.

17. The mobile terminal according to claim 11, wherein the first slot of the first radiating element is a bent slot.

18. The mobile terminal according to claim 11, wherein two ends of the first slot of the first radiating element are closed.

19. The mobile terminal according to claim 11, wherein an insulation layer is disposed in the first slot of the first radiating element.

20. The mobile terminal according to claim 11, wherein the first radiating element further comprises a second slot that is disposed at the metal layer and that is connected to the first slot, and the second slot is coupled to the at least one of the radiating stubs of the second radiating element.

* * * * *